US005951260A

United States Patent [19]

Cramer et al.

[11] Patent Number: 5,951,260

[45] Date of Patent: Sep. 14, 1999

[54] SYSTEM AND METHOD FOR ELECTRONIC AIR COMPRESSOR CONTROL

[75] Inventors: James A. Cramer; Dipchand V. Nishar, both of Columbus, Ind.

[73] Assignee: Cummins Engine Company, Inc., Columbus, Ind.

[21] Appl. No.: 08/848,865

[22] Filed: May 1, 1997

[51] Int. Cl.[6] ..... F04B 49/00

[52] U.S. Cl. ..... 417/282

[58] Field of Search ..... 417/292, 282, 417/23; 303/116; 137/522

[56] References Cited

U.S. PATENT DOCUMENTS

| | | | |
|---|---|---|---|
| 1,068,432 | 7/1913 | Hill | 417/292 |
| 1,262,667 | 4/1918 | Hill | 417/292 |
| 2,052,168 | 8/1936 | Crittenden et al. | 230/27 |
| 2,338,451 | 1/1944 | McCoy, Jr. | 230/31 |
| 3,594,093 | 7/1971 | Lukacs | 417/292 |
| 3,796,515 | 3/1974 | Lindqvist et al. | 417/23 |
| 3,961,862 | 6/1976 | Edstrom et al. | 417/282 |
| 4,459,085 | 7/1984 | Tonegawa | 417/282 |
| 4,473,093 | 9/1984 | Hart | 137/522 |
| 4,594,051 | 6/1986 | Gaston | 415/48 |
| 4,880,282 | 11/1989 | Makino et al. | 303/116 |
| 5,082,427 | 1/1992 | Fujiwara et al. | 417/292 |
| 5,141,407 | 8/1992 | Ramsey et al. | 417/292 |

*Primary Examiner*—Charles G. Freay
*Assistant Examiner*—Robert Z. Evora
*Attorney, Agent, or Firm*—Sixbey, Friedman, Leedom & Ferguson; Charles M. Leedom Jr; Tim L. Brackett Jr

[57] ABSTRACT

An electronic air compressor control system and method including an actuator connected to an air compressor for regulating the loading and unloading of the air compressor based on predetermined conditions, a power supply electrically connected to the actuator for supplying a voltage thereto and a plurality of switches electrically coupled to the actuator and power supply for controlling the supply of voltage from the power supply to the actuator in order to control the operation of the air compressor based on a predetermined air compressor exhaust temperature threshold and minimum and maximum pressure thresholds. The unloading and loading of the air compressor is based on a predetermined air compressor exhaust temperature when the pressure within the wet tank is between the minimum pressure threshold and the maximum pressure threshold.

20 Claims, 3 Drawing Sheets

SYSTEM AND METHOD FOR ELECTRONIC AIR COMPRESSOR CONTROL

TECHNICAL FIELD

This invention is generally directed to the field of air supply systems and more particularly to an electronic air compressor control system for limiting air compressor exhaust temperature to improve compressor durability.

BACKGROUND

Air compressors are used for a variety of applications which include, but are not limited to, air brake systems for over-the-road commercial trucks. Engineers are constantly seeking ways to improve air compressors in an effort to increase their useful life and durability, thereby reducing maintenance costs and system downtime.

One problem associated with conventional air compressor designs occurs when the compressor is run constantly causing the temperature of the air compressor exhaust gas to rise to levels that may be damaging to air compressor operation. To overcome this problem, some air compressors are run in loading and unloading cycles so that the air compressor does not overheat. Normally, an air compressor operates in a loading state where air is pumping into an adjacent wet tank. Upon certain predetermined conditions, the compressor unloads causing air to be pumped into the atmosphere.

An example of a conventional air compressor which operates in a manner similar to that described above is disclosed in U.S. Pat. No. 1,068,432 to Hill which teaches an air compressor control that utilizes a thermally actuated means to control the unloading of the air compressor to eliminate danger of an accident and place the compressor in a safe condition to be shut down. In order to accomplish this objective, Hill proposes that when the compressor becomes superheated, a valve is opened so that air within the compressor is exhausted directly from the cylinder to the atmosphere. This instantly relieves the pressure in the cylinder and stops the accretion of heat. Although the air compressor system of Hill discloses a method of protecting the air compressor from damage, the system of Hill merely unloads the compressor if a certain predetermined temperature is reached and is not dependent on wet tank pressure thresholds to yield efficient compressor loading and unloading operation.

U.S. Pat. No. 2,052,168 to Crittenden discloses a compressor protection device that is responsive to temperature conditions of the fluid compressed by a multicylinder compressor and includes a controller for unloading the compressor based on compressor operating conditions. When the pressure of the fluid within a reservoir adjacent the compressor reaches a predetermined value or upon the occurrence of other conditions to which the unloading means is responsive, the compressor is unloaded. The compressor remains unloaded until the unloading device of the compressor operates to effect loading. If the fluid compressed in a cylinder exceeds a predetermined value, then the cylinder is unloaded. The device of Crittenden provides for compressor safety and protection and may be effective in certain environments, however, the device does not appear to effectively control air compressor operation based on both sensed air compressor exhaust gas temperatures and an optimum wet tank pressure range to ensure efficient air compressor operation. In essence, the Crittenden device only relies on a limited number of conditions, such as one temperature limit or one pressure limit, to determined whether the compressor should be loaded or unloaded.

Another system disclosed in U.S. Pat. No. 3,961,862 to Edstrom et al. appears to provide a more efficient means of operation than the two systems discussed above. Edstrom et al. provides a compressor control system for unloading gas compressors in a way that reduces back pressure or working pressure in the discharge port and the compressor working chambers. The compressor of Edstrom et al. is arranged in a circuit with a closable chamber disposed upstream of the compressor gas inlet. A control circuit is operable to sense compressor discharge pressure and at a predetermined pressure condition, sequentially operate multiple valves to shut off compressor inlet flow, thereby evacuating the chamber and placing the compressor discharge port in communication with the chamber. In this mode, the compressor runs unloaded or at idle at a greatly reduced inlet and discharge pressure. By sensing the chamber vacuum or by the use of time delay devices, the unloading of the compressor may be controlled. Although the Edstrom et al. system is an improvement over the Hill and Crittenden devices with respect to the number of conditions used to determine whether a compressor should be loaded or unloaded, the system is rather complex in nature and thus, would appear to be very costly to manufacture and maintain.

In view of the references discussed above, there is clearly a need for a compressor control system that is inexpensive to manufacture and maintain, while providing effective and efficient compressor operation to improve the durability of the compressor and its useful life.

SUMMARY OF THE INVENTION

Based on the foregoing, it is an object of the present invention to provide an improved inexpensive compressor control system that limits air compressor exhaust temperature to improve compressor durability.

It is a further object of the present invention to achieve one or more of the above object and to provide an improved compressor control system that utilizes electrical/electronic switches to control the loading and unloading of a compressor.

It is another object of the present invention to achieve one or more of the above objects and to provide an improved compressor control system that utilizes at least two pressure switches which are used to control the loading or unloading of the compressor when the pressure within a wet tank connected to the compressor via an air dryer is above or below a predetermined threshold.

It is also an object of the present invention to achieve one or more of the above objects and to provide an improved compressor control system that uses a temperature switch to monitor compressor exhaust gas temperature and unloads the compressor when the wet tank pressure is between two predetermined pressure thresholds and the compressor exhaust gas temperature exceeds a predetermined temperature threshold.

It is yet a further object of the present invention to achieve one or more of the above objects and to provide an improved method of controlling an air compressor which includes the steps of monitoring wet tank pressure and compressor exhaust gas and determining whether the compressor should be loaded or unloaded based on the sensed conditions in order to yield efficient compressor operation.

These and other objects of the invention are achieved by an electronic air compressor control system comprising an actuating means connected to an air compressor for regulating the loading and unloading of the air compressor based on predetermined conditions, a battery means electrically connected to the actuating means for supplying a voltage thereto and a switching means electrically coupled to the actuating means and battery means for controlling the supply of voltage from the battery means to the actuating means in order to control the operation of the air compressor based on a predetermined air compressor exhaust temperature threshold and at least two pressure thresholds. The two pressure thresholds include a minimum pressure threshold and a maximum pressure threshold, wherein the unloading and loading of the air compressor is based exclusively on a predetermined air compressor exhaust temperature when the pressure within a wet tank in fluid communication with the air compressor is between the minimum pressure threshold and the maximum pressure threshold.

The switch circuit means includes at least two pressure switches and at least one temperature switch connected to the battery. The two pressure switches include a low pressure switch and a high pressure switch. The low pressure switch is connected in series with the temperature switch and the high pressure switch is connected in parallel with the low pressure switch and temperature switch. The low pressure switch opens when the wet tank pressure is below the minimum pressure threshold and the high pressure switch closes when the wet tank pressure is above the maximum pressure threshold. The temperature switch closes when the air compressor exhaust temperature exceeds the predetermined air compressor exhaust temperature threshold.

The above objects are further achieved by a method for controlling the operation of an electronic air compressor comprising the steps of sensing the pressure within the wet tank to determine whether the wet tank pressure is above or below a predetermined pressure threshold, unloading the air compressor if the wet tank pressure sensed during the sensing step is above a predetermined maximum pressure threshold and loading the air compressor if the wet tank pressure sensed during the sensing step is below a predetermined minimum pressure threshold. The temperature of the air compressor exhaust is monitored to determine whether the air compressor exhaust temperature exceeds a predetermined temperature threshold. If the air compressor exhaust temperature exceeds the predetermined temperature threshold and the wet tank pressure is between the predetermined minimum pressure threshold and the predetermined maximum pressure threshold, the air compressor is unloaded.

DETAILED DESCRIPTION OF THE PREFERRED EMBODIMENT

The present invention is designed for use in an air brake or air supply system found in over-the-road commercial vehicles which is described herein as the preferred embodiment. The present invention, however, may be used in other environments in which effective air compressor control is necessary or desired. For purposes of providing a concise, yet adequate disclosure, only the elements of the air supply system that are critical to the present invention are discussed herein. Nevertheless, reference is made to air supply system operation as affected by the critical elements of the preferred embodiment.

Figure 1:
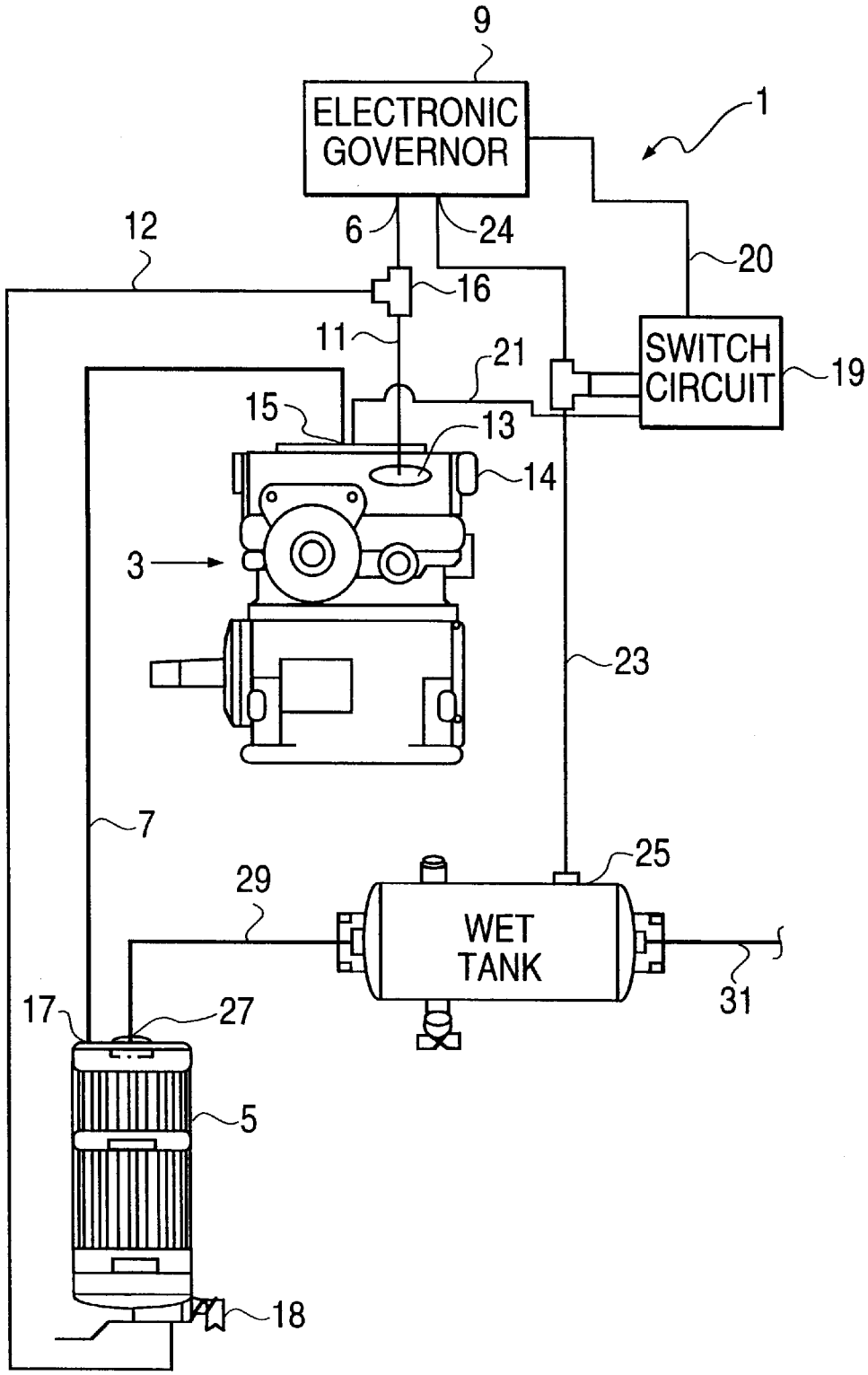
FIG. 1 is an air compressor system diagram of the preferred embodiment of the present invention.

FIG. 1 illustrates an air compressor control system 1 in accordance with the preferred embodiment of the present invention. Specifically, air compressor control system 1 includes an air compressor 3 which is in fluid communication with air dryer 5 through conduit 7 and electronic governor 9 through line 11. Air compressor 3, in the preferred embodiment of the present invention, is a Holset E-Type system air compressor manufactured by Holset Engineering Company, Inc.; however, any known air compressor may be utilized in connection with the present invention. Air compressor 3 is an engine drive, piston type compressor which supplies compressed air to operate air activated devices. The compressor operates continuously but has a loaded and unloaded operating mode. The operating mode is controlled by electronic governor 9 and the compressor unloading assembly. The installation of air compressor 3 in an air compressor control system should be governed by the recommended installation guidelines for the particular air compressor chosen.

Air compressor 3 includes an intake valve 14 which supplies the air compressor with ambient air. Moreover, air compressor 3 includes an exhaust valve 15 which releases compressed air into conduit 7 during compressor loading. The temperature of the compressed air entering conduit 7 is approximately 450° F. This temperature may be higher or lower depending on the amount of pressurization the air undergoes within air compressor 3.

The compressed air then enters air dryer 5 through intake valve 17. The compressed air suffers a heat loss of approximately 300° F. during its travel through conduit 7. Air dryer 5 operates to remove moisture from the compressed air to prevent down stream freeze-ups and corrosion of air lines, air tanks, and valving components. In addition, air dryer 5 functions as an oil and air contaminant removal system, which helps provide improved system performance and longer service life.

Once the moisture is removed, the dry, compressed air residing in air dryer 5 is discharged through exhaust port 27 and into wet tank 25 via conduit 29. The fresh, compressed air replenishes the air supply within wet tank 25. The compressed air is stored in wet tank 25 until the air supply system (not illustrated) uses the compressed air for its intended purpose, such as braking. In this instance, compressed air is supplied to the air supply system through conduit 31.

Fluid line 11 connects a governor output valve 6 with a compressor unloader valve 13 which may be actuated to release air into the atmosphere. When compressor unloader valve 13 is actuated by electronic governor 9, compressed gas within air compressor 3 is forced through fluid lines 11 and 12 which communicate via a T-connector 16. The unloaded gas may be fed into the atmosphere through an output valve 18 positioned adjacent air dryer 5, or into an intake system, depending on the type of compressor used.

Electronic governor 9 is an actuator which is electrically coupled to a switch circuit 19 through line 20 and operates based on the electrical signal received therefrom. In addition, electronic governor 9 includes a governor input valve 24 which is fluidly connected to wet tank 25 via conduit 23. Wet tank air pressure enters electronic governor 9 and is stored in an area directly below an electronically actuated piston (not shown) which is moved from a first, lower position to a second, higher position based on an electrical signal received from switch circuit 19. The pressurized air is subsequently forced through governor outlet valve 6, when the electronically actuated piston (not shown) is returned to its first, lower position. The release of the compressed air modulates the air pressure to compressor unloader valve 13. Electronic governor 9 preferably used in the present invention is also manufactured by Holset Engineering Company, Inc.

Figure 2:
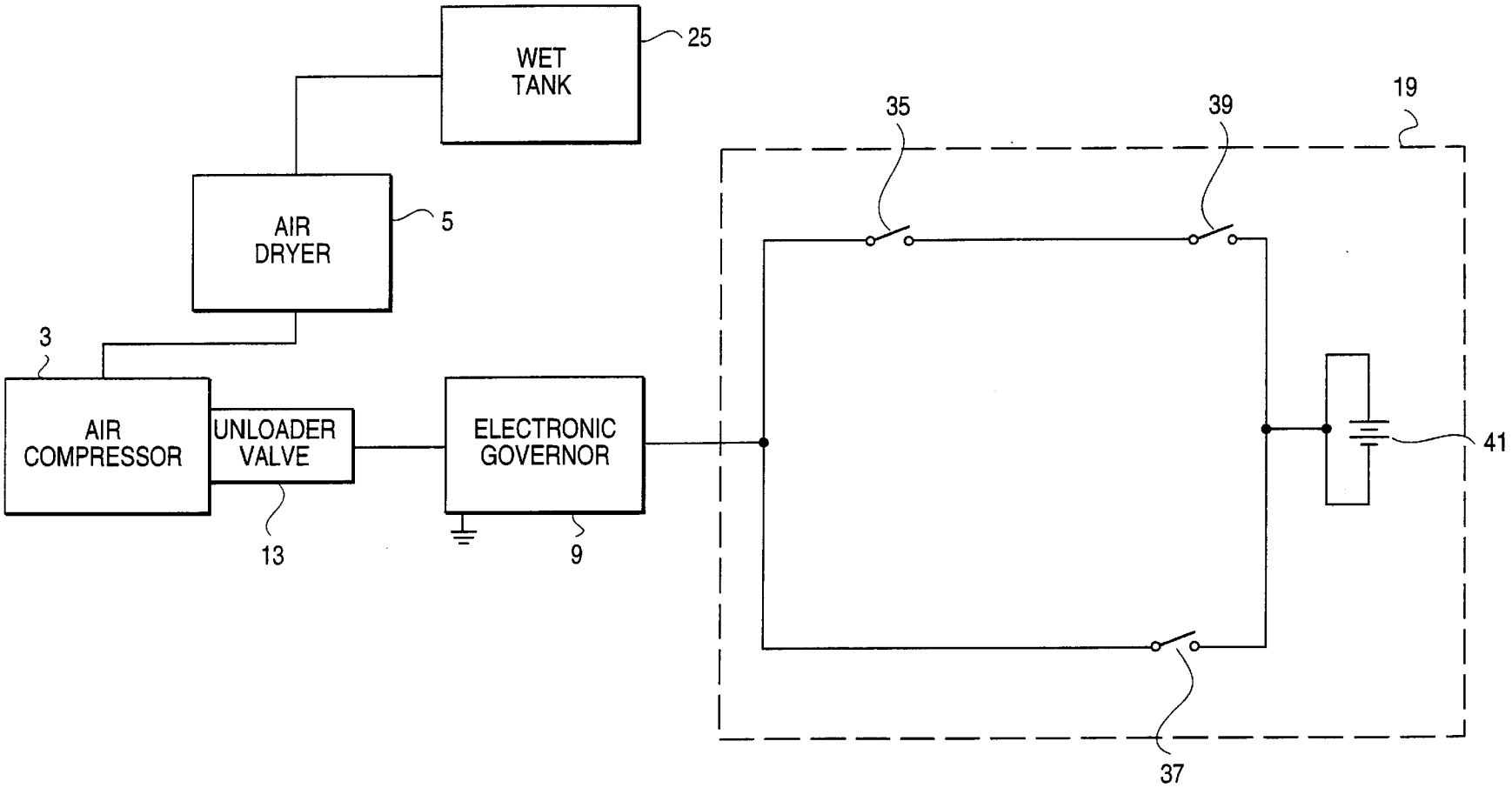
FIG. 2 is a schematic circuit diagram of a switch circuit used in the air compressor system in accordance with the preferred embodiment of the present invention.

The control feature of the present invention is shown in FIG. 2 which illustrates a schematic diagram of switch circuit 19 as provided in air compressor control system 1 (shown in FIG. 1). Switch circuit 19 includes a low pressure switch 35, a high pressure switch 37, a temperature switch 39, and a power supply such as battery 41, which operate to control the loading and unloading of air compressor 3. The pressure and temperature switches used in the present invention may be electrical/electronic switches with relay devices, which are illustrated in FIG. 2, or any other similar switching device. Fuses may be used in conjunction with the electrical/electronic switches depending on the current carrying capacity of each switch.

Low pressure switch 35 is connected in series with temperature switch 39 and high pressure switch 37 is formed in parallel with respect thereto. Wet tank 25 pressure is monitored by low pressure switch 35 and high pressure switch 37, as the compressed air travels from the wet tank to electronic governor 9 through fluid conduit 23 (shown FIG. 1). The wet tank pressure is monitored to ensure that an adequate supply of compressed air resides in the tank and thus, is available to the air supply system (not shown). To accomplish this, air compressor control system 1 (shown in FIG. 1) operates to maintain the pressure within the wet tank between predetermined thresholds. If the pressure drops below a low pressure threshold, compressed air is added to the wet tank. If the pressure exceeds a high pressure threshold, then no compressed air is added.

As stated above, low pressure switch 35 and high pressure switch 37 operate based on the sensed pressure conditions in wet tank 25. Moreover, temperature switch 39 operation is dependent on the sensed air compressor exhaust gas temperature which is monitored by temperature switch 39 via line 21 shown in FIG. 1. Whether a voltage from battery 41 is supplied to electronic governor 9 is dependent on the "open" or "closed" state of the pressure and temperature switches. If any switches in switch circuit 19 are in a "failed" state, such as a defective temperature or pressure switch, air compressor 3 continues to operate in a loaded mode.

Battery 41 supplies either 12 or 24 volts to electronic governor 9 when either high pressure switch 37 is closed or both low pressure switch 35 and temperature switch 39 is in a closed position. The voltage supplied by battery 41 may be higher or lower depending the electrical requirements of the environment in which the switch circuit feature of the present invention is installed. The supplied voltage merely signals electronic governor 9 to activate compressor unloader valve 13.

Under normal operation conditions, air compressor 3 is in a loading state. Switch circuit 19 operates in conjunction with electronic governor 9 to protect the air compressor from extreme temperatures, sensed by temperature switch 39, which can effect compressor durability and useful life. In addition, switch circuit 19 and electronic governor 9 operate to ensure that an adequate supply of compressed air is stored in wet tank 25 for use by the air supply system.

In the preferred embodiment, high pressure switch 37 is maintained in an open position, thereby blocking voltage from passing therethrough. If the wet tank pressure exceeds a predetermined high pressure threshold, such as 125 psi, high pressure switch 37 closes allowing a voltage to pass and causing electronic governor 9 to initiate air compressor unloading. If the wet tank pressure is below the predetermined high pressure threshold, the air compressor unloads only when low pressure switch 35 and high temperature switch 39 are closed. Low pressure switch 35 is maintained in a closed position under normal conditions. If the pressure within wet tank 25 drops below a predetermined pressure threshold, such as 90 psi, low pressure switch 35 opens, thereby preventing any passage of voltage.

High temperature switch 39 is open under normal conditions and only closes when the air compressor exhaust gas temperature exceeds a predetermined temperature, such as 475° F. Therefore, air compressor 3 unloads when the pressure within wet tank 25 is between the low pressure threshold (low pressure switch closed) and the high pressure threshold (high pressure switch open), and the air compressor exhaust gas temperature threshold (temperature switch closed) is exceeded. Therefore, the operation of air compressor 3, when the wet tank pressure is between the respective predetermined thresholds, is solely controlled by temperature switch 39.

Upon receiving an electronic signal from switch circuit 19, electronic governor 9 automatically controls the air pressure in the air brake or air supply system between the desired predetermined maximum and minimum pressures. As indicated by the pressure and temperature switch operation discussed above, the compressor runs continually while the vehicle engine runs (if used on a vehicle), but the actual compression of air is controlled by the electronic governor actuating compressor unloader valve 13. The unloader valve actuation stops or starts compression when the maximum or minimum wet tank pressures are reached.

Figure 3:
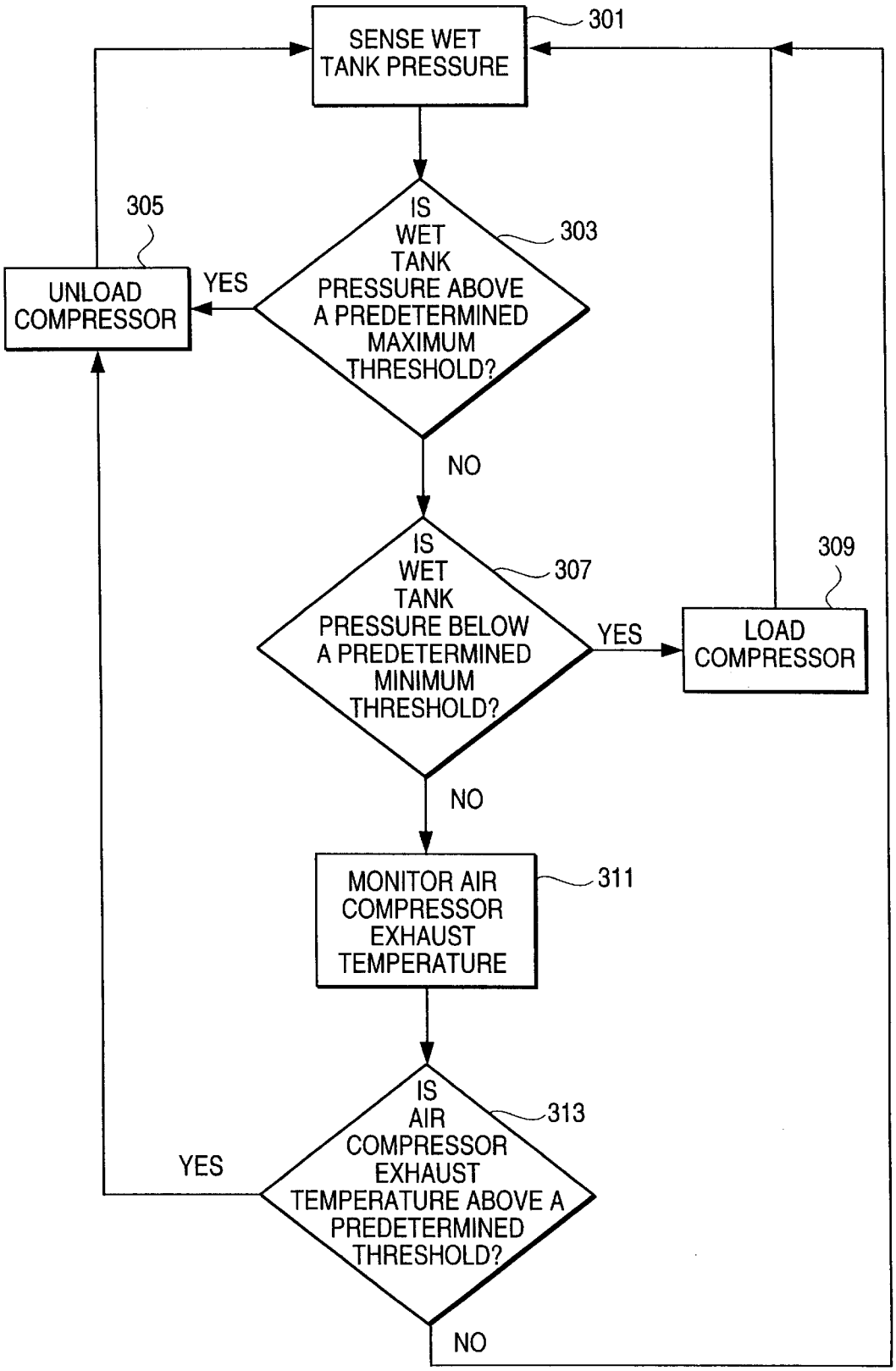
FIG. 3 is a flow chart of a method of controlling the operation of a compressor in accordance with the preferred embodiment of the present invention.

FIG. 3 is a flow chart of a method of controlling the operation of an air compressor in accordance with the preferred embodiment of the present invention. The method described herein is directed to steps by which air compressor control system 1 operates to effectively and efficiently control air compressor operation. In the present invention, air compressor 3 is loaded or unloaded only when it is necessary to either protect the air compressor from excessive temperatures or to ensure that a sufficient amount of air resides in wet tank 25. When the measured pressure within the wet tank is within a desired range, only the air compressor exhaust gas temperature is used to determine air compressor loading and unloading. This allows the compressor continuously generate a fresh supply of compressed air to the air supply system. Moreover, the durability of the air compressor is improved because the temperature threshold, usually specified by the air compressor manufacturer, is used to effectively regulate air compressor operation.

Referring now to FIG. 3, air compressor control process begins with sensing the pressure within the wet tank, as illustrated in block 301. The sensed pressure is first compared to the predetermined high pressure threshold, as shown in block 303. If the sensed wet tank pressure is above the predetermined high pressure threshold, then the switch circuit signals the electronic governor to initiate compressor unloading, as provided in block 305. If the sensed wet tank pressure is below the predetermined high pressure threshold, then the sensed wet tank pressure is compared to the predetermined low pressure threshold, in block 307. If the sense wet tank pressure is below the predetermined low pressure threshold, then the air compressor loads, as shown in block 309. If the sensed wet tank pressure is above the predetermined minimum pressure threshold, then the air compressor exhaust temperature is sensed in block 311. The sensed air compressor exhaust gas temperature is then compared to a predetermined temperature threshold, illustrated in block 313. If the air compressor exhaust temperature is above the predetermined temperature threshold and the wet tank pressure is between the predetermined low pressure threshold and the high pressure threshold, then the air compressor unloads. If not, then the process is repeated beginning with the sensing of the wet tank pressure, shown in block 301.

The present invention as described herein provides a low cost, electronic air compressor control system for effective and efficient compressor operation by limiting air compressor exhaust temperature to improve the durability of the compressor and its useful life.

While the invention has been described with reference to the aforementioned embodiments, it should be appreciated by those skilled in the art that the invention may be practiced otherwise than as specifically described herein without departing from the spirit and scope of the invention. It is therefore understood that the spirit and scope of the invention be limited only by the appended claims.

INDUSTRIAL APPLICABILITY

The electronic air compressor control system may be used in any environment or for any application which requires reliable control of an air compressor to improve compressor life and durability.

What is claimed is:

1. An electronic air compressor control system for use with a wet tank, comprising:

an air compressor;

an actuating means fluidly connected to said air compressor for regulating a loading and unloading of the air compressor based on predetermined conditions;

a power supply means electrically connected to said actuating means for supplying voltage thereto; and a switch means electrically coupled to said actuating means and said power supply means for controlling a supply of voltage from said power supply means to said actuating means in order to control the operation of said actuating means based on a predetermined air compressor exhaust temperature threshold, and at least a minimum pressure threshold and a maximum pressure threshold in a manner that said unloading and loading of the air compressor is based on a predetermined air compressor exhaust temperature when the pressure within a wet tank fluidly connected to the air compressor is between said minimum pressure threshold and said maximum pressure threshold.

2. The system of claim 1, wherein said switch means includes at least two pressure switches and at least one temperature switch.

3. The system of claim 2, wherein said at least two pressure switches includes a low pressure switch and a high pressure switch.

4. The system of claim 3, wherein said low pressure switch is connected in series with said at least one temperature switch.

5. The system of claim 4, wherein said high pressure switch is connected in parallel with said low pressure switch and said at least one temperature switch.

6. The system of claim 3, wherein said low pressure switch opens when the wet tank pressure is below said minimum pressure threshold.

7. The system of claim 6, wherein said high pressure switch closes when the wet tank pressure is above said maximum pressure threshold.

8. The system of claim 6, wherein said at least one temperature switch closes when the air compressor exhaust temperature exceeds said predetermined air compressor exhaust temperature threshold.

9. The system of claim 1, wherein said actuating means is connected to said air compressor through an unloader valve.

10. An electronic air compressor control system comprising:

an air compressor;

an actuator fluidly connected to said air compressor for regulating a loading and unloading of said air compressor;

a power supply in electrical communication with said actuator through a parallel circuit comprising a first circuit branch and a second circuit branch, each of said first and second circuit branch including at least one switch electrically connected to said actuator and said power supply for controlling a supply of voltage through respective said first circuit branch and said second circuit branch from said power supply to said actuator in order to control the operation of said actuator based on a predetermined air compressor exhaust temperature threshold, a minimum pressure threshold, and a maximum pressure threshold, wherein an unloading and loading of the air compressor is based on a predetermined air compressor exhaust temperature when the pressure within a wet tank fluidly connected to the air compressor is between said minimum pressure threshold and said maximum pressure threshold.

11. The system of claim 10, wherein said parallel circuit includes a plurality of switches including at least two pressure switches and at least one temperature switch.

12. The system of claim 11, wherein said at least two pressure switches includes a low pressure switch and a high pressure switch.

13. The system of claim 12, wherein said first circuit branch includes said low pressure switch connected in series with said at least one temperature switch.

14. The system of claim 13, wherein said second circuit branch includes said high pressure switch such that said high pressure switch is connected in parallel with said low pressure switch and said at least one temperature switch of said first circuit branch.

15. The system of claim 11, wherein a failure of at least one of said plurality of switches causes the air compressor to load.

16. The system of claim 12, wherein said low pressure switch opens when the wet tank pressure is below said minimum pressure threshold.

17. The system of claim 16, wherein said high pressure switch closes when the wet tank pressure is above said maximum pressure threshold.

18. The system of claim 16, wherein said at least one temperature switch closes when the air compressor exhaust temperature exceeds said predetermined air compressor exhaust temperature threshold.

19. The system of claim 10, wherein said actuator is connected to said air compressor through an unloader valve.

20. A method for controlling the operation of an air compressor fluidly connected with a wet tank, comprising the steps of:

sensing a pressure within the wet tank to determine whether the wet tank pressure is above or below a predetermined pressure threshold;

unloading the air compressor by operating an actuator if the wet tank pressure sensed during said sensing step is above a predetermined maximum pressure threshold;

loading the air compressor by operating said actuator if the wet tank pressure sensed during said sensing step is below a predetermined minimum pressure threshold;

monitoring the temperature of the air compressor exhaust to determine whether the air compressor exhaust temperature exceeds a predetermined temperature threshold; and unloading the air compressor by operating said actuator if said air compressor exhaust temperature exceeds said predetermined temperature threshold and the wet tank pressure is between said predetermined minimum pressure threshold and said predetermined maximum pressure threshold.

* * * * *